United States Patent [19]

Mims

[11] Patent Number: 4,511,000

[45] Date of Patent: Apr. 16, 1985

[54] BITUMEN PRODUCTION AND SUBSTRATE STIMULATION

[75] Inventor: Donald S. Mims, Houston, Tex.

[73] Assignee: Texaco Inc., White Plains, N.Y.

[21] Appl. No.: 469,678

[22] Filed: Feb. 25, 1983

[51] Int. Cl.[3] ..... E21B 36/00; E21B 43/12; E21B 43/24

[52] U.S. Cl. ..... 166/303; 166/272; 166/50; 166/306

[58] Field of Search ..... 166/50, 57, 157, 180, 166/187, 191, 272, 274, 302, 303, 306

[56] References Cited

U.S. PATENT DOCUMENTS

| | | | |
|---|---|---|---|
| 3,126,961 | 3/1964 | Craig, Jr. et al. | 166/303 |
| 3,994,340 | 11/1976 | Anderson et al. | 166/272 |
| 4,026,359 | 5/1977 | Closmann | 166/272 |
| 4,116,275 | 9/1978 | Butler et al. | 166/57 |
| 4,344,485 | 8/1982 | Butler | 166/272 |
| 4,362,213 | 12/1982 | Tabor | 166/267 |
| 4,368,781 | 1/1983 | Anderson | 166/274 |

*Primary Examiner*—Stephen J. Novosad

*Assistant Examiner*—William P. Neuder

*Attorney, Agent, or Firm*—Robert A. Kulason; Robert B. Burns

[57] ABSTRACT

A well completion, having an injection end and a recovery end, and method for recovering heavy hydrocarbons or bitumen from a subterranean formation. The completion includes a well liner which lies in a generally horizontal disposition within a hydrocarbon holding substrate. Means for carrying a stream of a hot stimulating fluid from the well's injection end such that said fluid will migrate into the substrate surrounding the liner. A fluid impervious barrier is movably positioned within the well liner between the injection end and the production end thereof, and prompts establishment of a pressure differential across the said barrier. The barrier urges pressurized stimulating agent outwardly into the substrate, thereby creating a heated path along which the bitumen emulsion flows toward the well's lower pressure production end. The barrier is adapted to be repositioned within the liner to adjust the bitumen flow path through the substrate.

8 Claims, 2 Drawing Figures

BITUMEN PRODUCTION AND SUBSTRATE STIMULATION

BACKGROUND OF THE INVENTION

In the production of viscous hydrocarbon such as heavy crude and bitumen from tar sands, it is necessary to thoroughly stimulate the viscous material by lessening its viscosity to flowable condition. Thus, the bitumen, in emulsion form, can flow or be withdrawn from the substrate.

Usually thermal stimulation comprises the introduction of a pressurized flow of a heating medium such as steam into the substrate by way of an injection well. In the instance of tar sands, this step, over a period of time, liquefies the bitumen and releases it from its retained condition in the tar sand and causes formation of a mixture with condensate. The steam also establishes a pressure front whereby to urge the now flowable hydrocarbon mixture toward one or more spaced apart production wells.

Although the hereinafter described method and apparatus can be applied to the production of either bitumen or heavy crude oil, the following disclosure will define the invention in terms of the production of bitumen from a tar sand environment.

A preferred method adapted to viscous hydrocarbon production utilizes a single well which is sequentially heated, and produced to operate on a cyclical principle. More specifically, the substrate surrounding the well is initially preheated under pressure to convert bitumen into flowable condition.

Thereafter, during a soak period, steam is condensed, and heat is absorbed into the substrate thereby causing the bitumen emulsion or mixture to gravitate toward the lower pressure well and be produced therefrom.

When, over a period of time, ambient pressure within the substrate becomes depressed, it is necessary to recommence the cycle by the further introduction of a stimulating medium. As a sufficiently high heat and pressure environment is reestablished and bitumen emulsion is again caused to flow, steam injection is discontinued or minimized. Further controlled draining of bitumen emulsion can now be resumed.

This cyclical process can be repeated indefinitely until the area adjacent to the well becomes exhausted of hydrocarbon product. The method is generally referred to as the huff and puff process. It is found to function effectively particularly when the stimulating medium is steam.

In an alternate method of producing hydrocarbons from a substrate, a plurality of vertical walls are drilled in a desired pattern. Thereafter, the stimulating fluid such as steam, under pressure, is injected for a period of time into the substrate by way of a centrally located injector well.

The heated or stimulated area about the well will gradually be widened, thereby establishing an expanding pressure front. The latter urges flowable bitumen emulsion toward the surrounding producing wells. This process is advantageous in that it can be practiced by a continuous, rather than a cyclical introduction of stimulating fluid.

Tar and deposits generally occur in horizontal layers. It has been found desirable therefore, toward achieving an improved hydrocarbon production rate, to utilize a generally horizontally disposed well for producing from the layer. However, the nature of the horizontal well mandates that the latter operate on a cyclical basis to realize an appreciable outflow of bitumen emulsion. Since this cyclical operation amounts to disruption of the producing phase, it constitutes a less than desirable expedient.

To increase the rate of production from a horizontal well of the type contemplated, there is presently provided an efficient method and apparatus for establishing a flowable bitumen emulsion in and through a tar sand environment. The process is effectuated through use of an elongated, horizontal well which traverses at least a portion of the tar sands layer.

A vertical well is positioned to intersect or terminate in the region of the horizontal well and serves to facilitate the producing process as well as to provide communication with the horizontal well.

Operationally, both the horizontal well and the adjacent substrate are initially preheated to establish a favorable operating temperature at which fluidized bitumen emulsion can flow. The horizontal well liner embodies a liner which includes longitudinally adjustable means or barrier therein, to outwardly divert the stimulating steam. The fluid thereby creates a hot path along which subsequent bitumen emulsion flows. Said hot path communicates the relatively high pressurized injection area where the stimulating fluid is introduced, with a lower pressure area through which production takes place.

Thereafter, and subsequent to the preheating step, the well is produced by the controlled introduction of a stimulating fluid as needed. This latter introduction, together with regulation of the well back pressure, causes fluidized bitumen emulsion to be urged to the well producing end.

As one area of the adjacent substrate becomes depleted, the steam flow is altered to establish new paths by adjusting the location of the steam diverting barrier horizontally along the well liner.

It is therefore an object of the invention to provide the method and apparatus for improving production output of a viscous hydrocarbon fluid from a subterranean reservoir in which the fluid is locked. A further object is to provide a method and apparatus for thermally stimulating and producing a well aligned substantially horizontally within a formation which contains a relatively viscous hydrocarbon. A still further object is to provide a method and apparatus for the continuous production of viscous hydrocarbon fluids from a single well disposed substantially horizontally through a bitumen holding formation.

Figure 1:
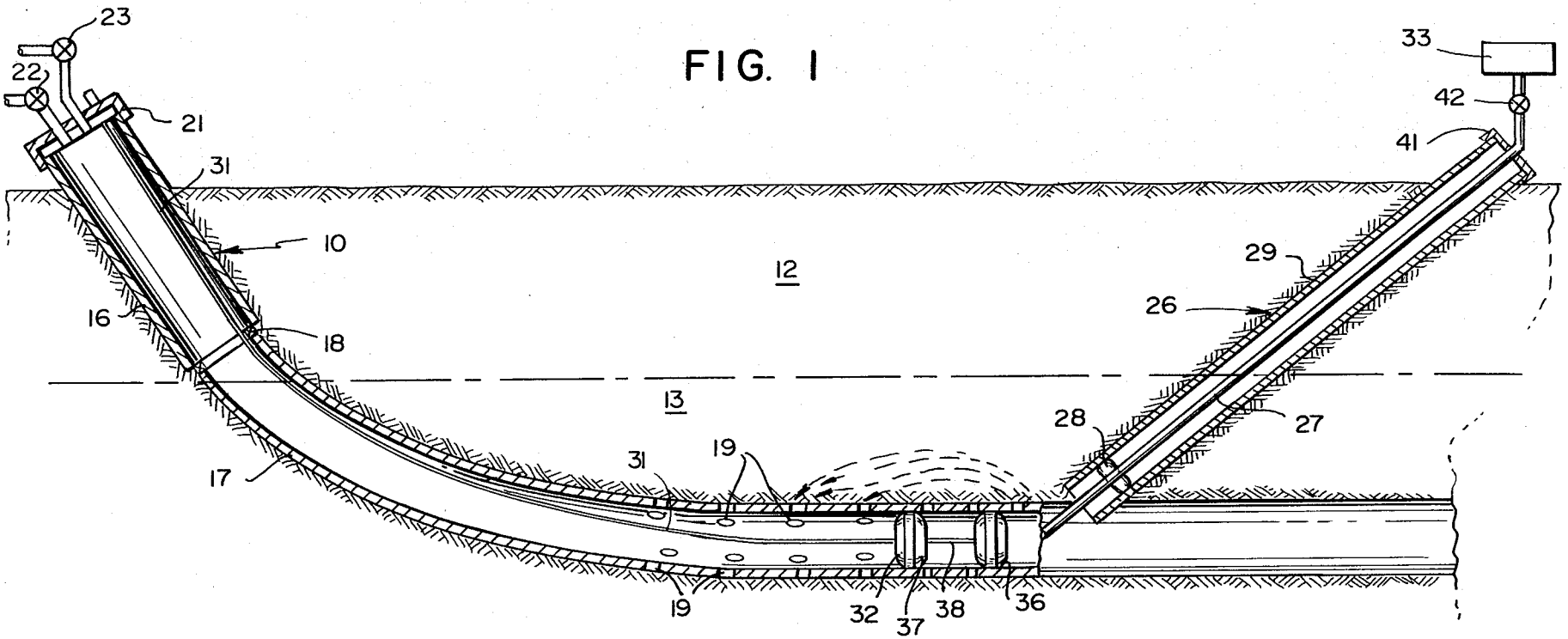
FIG. 1 illustrates in a cross-section elevation, a horizontal well of the type contemplated.

Referring to the drawings, a well 10 of the type contemplated is shown, which enters the ground at a vertical or near vertical alignment. Preferably the well is disposed at an angle to the ground surface 11. The well bore 15 is initially commenced through overburden 12 which overlies the productive or tar sand layer 13.

Thereafter, partway through overburden layer 12, the well bore is deviated from its original direction in a manner that at least a segment of it lies in a generally horizontal relationship with respect to the earth surface 11. Preferably the well bore extends coextensively with the tar sand layer. Further, it is preferably positioned at such a depth as to be adjacent to the lower border of the hydrocarbon containing layer 13.

Following usual drilling and completion practice, well bore 15 is provided at the upper end with a series of casing lengths 16. The latter can progressively decrease in size and are grouted in a manner best suited to the condition.

An elongated liner 17 is inserted through the respective casings 16, being supported at the lower end of casing 16 by a liner hanger 18. The latter is structured to allow passage of hot bitumen emulsion therethrough during the producing stage.

Structurally, one embodiment of elongated liner 17 comprises a steel tubular member which is perforated, either before or after insertion, along that portion thereof which lies within the tar sand layer 13. Perforation 19 in the liner wall can embody ordinary holes, or alternately slotted openings which extend either horizontally, or circumferentially through the liner wall.

In any event, liner openings 19 are sufficiently large in diameter to permit a discharge of heating medium therethrough and into the tar sand substrate 13. Further, these openings 19 allow the return flow of bitumen emulsion or mixture thereto when the latter is in flowable condition.

The upper or external end of liner 17 is provided with a closure such as a well head 21. The latter includes a series of valves 20 and 20' which are operable to regulate flow of the heating or stimulating medium, as well as maintain a desired pressure within the liner.

Horizontal well 10 can extend for a suitable distance through the tar sand layer 13 to a length at which it might effectively operate.

At the remote or buried end of horizontal well 10, a second well 26 is formed. Said second well is located such that it terminates in or intersects the region of the first well 10. Second well 26 is presently shown and described as being in a substantially vertical alignment relative to surface 11. It can however be inserted into the substrate at an angle to intercept the first well 10's region at a predetermined desired angle.

Second well 26 includes a liner or casing 29 which extends therethrough to terminate approximately at the intersection region of the two well bores. A fluid conductor or conduit 27 is positioned within second well 26 and comprises primarily an elongated tube-like member having a packer 28 at the lower end thereof. Said packer is operable to expand and engage the adjacent wall of casing 29 whereby to form a fluid tight annular seal.

Well 10 is provided with means to receive a barrier placement tool 31, such as a rigid bridge plug setting or removing tool. The latter extends upwardly through well 10 and terminates at the surface 11. Said rigid bridge plug setting or removing tool functions to engage one side of the barrier means or bridge plug 32, whereby to conduct a fluid to activate the latter between expanded and contracted positions, and to thereby position or displace the plug.

The plug 32 functions to divert the flow of heating fluid from the horizontal liner 17, outwardly and into the substrate 13. Barrier means 32 as shown, comprises in one embodiment a substantially fluid impervious, elongated member having two or more outwardly expandable terminal pieces 36 and 37, such as two or more bridge plugs, at opposed ends thereof. Connecting means such as a cable 39 or the like engage the respective terminal pieces to permit movement of one such piece, while the other is stationary.

Said terminal pieces 36 and 37 are of the type often associated with well treatment procedures. Functionally, they can, when actuated to the expanded mode, engage the adjacent liner wall to segregate a segment of a liner thereby to avoid entry of a fluid thereinto.

The barrier means 32 is connected to or removably engaged with barrier setting tool 31. The latter can in one embodiment comprise a conduit capable of connecting to and carrying an activating fluid.

Operationally, by altering one or both terminal pieces 36 and 37 to the contracted mode, the latter can be adjusted or displaced longitudinally through the liner 17. At the commencement of a producing operation, barrier means 32 is initially disposed at the remote end of liner 17.

Thus, hot stimulating fluid can be introduced to the injection segment of horizontal well 10 by way of conduit 27. It will thence be diverted into the surrounding substrate 13 by way of liner 17. However, fluid in the liner will not pass the terminal piece 36. Thus, in moving through the substrate the flow paths will bypass barrier means 32. Continued flow of the stimulating fluid will thus establish a fixed pattern of flow paths which terminate in the liner 17 producing end.

Well 26 as shown, includes a cap 41 through which conduit 27 passes, and which embodies a flow control valve 42. When conduit 27 is communicated to a source 33 of pressurized stimulating fluid such as steam, flow of the latter toward well 10 can be readily regulated.

Figure 2:
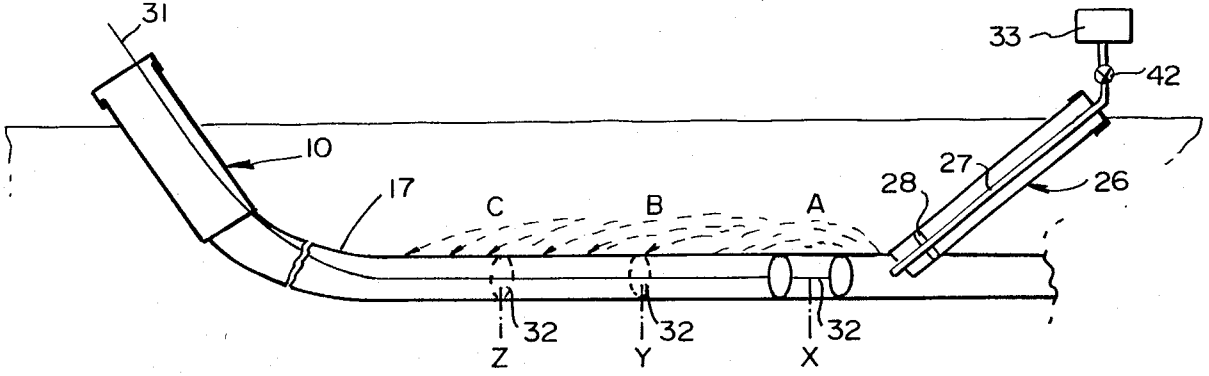
FIG. 2 is a schematic representation of the disclosed producing method.

In a preferred operation of the method, and referring to FIG. 2, hot stimulating fluid such as pressurized steam will be introduced initially from conductor 27 into horizontal well 10. Diverter means 32 as noted, is initially disposed at the remote end of liner 17 but longitudinally movable through the liner. Steam from conduit 27 will thus enter liner 17 at the injection segment of the latter. The steam will then be diverted from perforations 19, into the surrounding substrate 13. Over a period of time part of the steam will condense, but part will form a heated, progressively expanding stimulated area.

During this initial heating period, steam condensate will contact heated bitumen to form a flowable emulsion, or mixture.

Since the stimulant is injected under a pressure usually of about 300 psi, the hot stimulating fluid will tend to form a pattern of flow paths A through the substrate merely by liquefying the bitumen to flowable state. The presence of diverter means 32 within horizontal liner 17, divides the latter into two discrete segments.

One of the well segments, at the injection end, will ordinarily be subject to the higher pressure steam than the producing segment at the diverter downstream side. Thus, as liquefied bitumen forms into an emulsion or mixture, it will move toward the said lower pressure segment of liner 17 and thereby enter the latter through ports 19.

By maintaining the position of diverter means 32, and with the continued injection of steam, a steady flow of bitumen emulsion will pass into the production end of liner 17 and be produced at well head 21.

The production rate of emulsion can be facilitated by adjusting the liner 17 pressure at well head 21. More specifically the rate of production can be altered by controlling the back pressure within liner 17 through valves 22 and 23 at well head 21. Thus, the flow of the hot bitumen emulsion can be encouraged by reducing the pressure in liner 17 even to the point of establishing a vacuum atmosphere.

Over a period of time, establishment of the bitumen mixture flow paths A through the substrate 13 will exhaust that particular area of bitumen. It is desirable, and even necessary therefore to adjust flow paths A which communicate the liner 17 producing and injection ends. This is achieved by causing the hot stimulating fluid to penetrate an area not heretofore fully contacted.

Physically this is achieved by adjusting the position of diverter means 32 within liner 17. More particularly it is effectuated by maintaining element 36 in place, then contracting terminal piece 37 and displacing it from its original position at location X, toward the well producing end at location Y.

Thereafter, further injection of steam into conductor 27 and liner 17 will build up a pressure between members 36 and 37, thus preventing emulsion from entering the liner. It will also force the stimulating fluid into heretofore unaffected areas of the substrate as it gravitates toward the lower ambient pressure section of the liner. The hot steam will thus gradually cause the flow path pattern A to be extended to and form a new pattern B.

When the production rate of bitumen mixture decreases sufficiently, the process is repeated by again displacing terminal pieces 37 to location Z. At the latter a new flow path pattern C will be established by hot stimulating fluid to accommodate the bitumen mixture.

After terminal piece 37 has been relocated a sufficient distance along liner 17, the connecting cable 39 will be extended to its length. Thereafter, further adjustment in the diverter 32 location will cause both terminal pieces 36 and 37 to be concurrently progressed along liner 17. Eventually, the progression of flow paths through the substrate will be such that the entire area along liner 17 will be swept and the bitumen extracted therefrom.

Although modifications and variations of the invention can be made without departing from the spirit and scope thereof, only such limitations should be imposed as are indicated in the appended claims.

I claim:

1. Well completion in a substrate for producing viscous hydrocarbon by thermal stimulation of the substrate in which said hydrocarbon is retained, with a hot stimulating fluid, which completion includes;

an elongated well liner which is disposed in a first well bore formed in the substrate, at least a portion of said elongated well liner being perforated and extending in a substantially horizontal disposition through said layer, and having a well head at the liner production end, at least one secondary well formed in the substrate and terminating in a region adjacent to a portion of the first well bore, a diverter means movably positioned within said well liner and being operable between expanded and contracted modes, and said diverter means having a peripheral edge disposed contiguous with the inner wall of said liner and being adapted when in the expanded mode to contact said liner inner wall to prevent flow of fluid therethrough, a substrate stimulating system including a conduit disposed in said at least one secondary well and adapted at one end to communicate with a hot, pressurized source of said hot stimulating fluid, said conduit other end opening in a region of the first well bore, whereby to direct a pressurized flow of the hot stimulating fluid into the vicinity of the elongated well liner and into the liner remote end, diverter positioning means communicated with said diverter means, and being operable to longitudinally adjust the location of said diverter means along the well liner in a direction toward the well head, said diverter means including longitudinally spaced apart terminal pieces which are communicated with said diverter positioning means, each terminal piece being operable between contracted and expanded positions whereby each of said terminal pieces is independently operable for progressively lengthening the spacing between the respective terminal pieces.

2. A well completion as defined in claim 1, wherein said diverter means includes;

spaced apart terminal pieces, each thereof having an outwardly expandable peripheral portion disposed contiguous with, but spaced from the liner wall when the diverter is in the contracted mode, and said peripheral portion being disposed in sealing engagement with the liner wall when said diverter member is actuated to the expanded mode, each of said terminal members being independently communicated with said diverter positioning means, whereby the locations of the respective end members can be individually moved toward said well head.

3. Method for producing viscous hydrocarbons by thermal stimulation of a substrate layer which holds said hydrocarbons, which method includes the steps of;

providing a first well bore, which extends from the surface, into the substrate layer, being disposed in a substantially horizontal disposition through the latter, and having a perforated liner which extends substantially the length of said well bore between the surface, and the well remote end, forming a second well bore through the substrate in a direction to establish communication with the remote end of said first well, providing a stimulating fluid diverter member within said perforated liner, having opposed diverter end pieces which are independently operable within said liner to divide said liner into adjustable length injection segments, and production segments, and introducing a flow of hot, pressurized stimulating fluid into said liner injection segment, whereby said hot fluid will contact one of said diverter member end pieces and be directed from the perforated liner, outwardly into the substrate thereby to heat the latter and to enhance production of an aqueous hydrocarbon mixture therefrom by establishing a flow path pattern for said hydrocarbon mixture through the substrate and which pattern terminates intermediate the other of said diverter end piece in said liner producing end.

4. In the method as defined in claim 3, including the step of progressively relocating said stimulating fluid diverter end pieces, independently along said liner in incremental distances toward the well producing end.

5. In the method as defined in claim 3, wherein the stimulating fluid is steam.

6. In the method as defined in claim 3, wherein the stimulating fluid is a hot aqueous mixture.

7. In the method as defined in claim 3, including the step of; maintaining a pressure in the production segment of the liner of the diverter member, which is less than the pressure in the liner injection segment.

8. In the method as defined in claim 3, including the step of; maintaining said well liner injection segment constant while decreasing the producing segment thereof whereby to extend the flow path pattern toward said production segment.

* * * * *